United States Patent [19]

Roberts, Jr.

[11] 4,026,348

[45] May 31, 1977

[54] HEAT PIPE SWITCH

[75] Inventor: Charles Chester Roberts, Jr., Warrenville, Ill.

[73] Assignee: Bell Telephone Laboratories, Incorporated, Murray Hill, N.J.

[22] Filed: Oct. 6, 1975

[21] Appl. No.: 619,700

[52] U.S. Cl. ..... 165/32; 165/105; 237/9 R

[51] Int. Cl.[2] ..... F28D 15/00

[58] Field of Search ..... 165/32, 96, 105; 237/9

[56] References Cited

UNITED STATES PATENTS

| | | | |
|---|---|---|---|
| 2,289,879 | 7/1942 | Fiene | 165/105 X |
| 3,776,304 | 12/1973 | Auerbach | 165/105 X |
| 3,934,643 | 1/1976 | Laing | 165/105 X |

*Primary Examiner*—Albert W. Davis, Jr.

*Attorney, Agent, or Firm*—John C. Albrecht

[57] ABSTRACT

Thermal energy transfer apparatus having a controllably variable thermal conductance comprises a heat pipe having a capillary wick structure therein, a circulating supply of working fluid which is controlled by a heater, and a thermostatic heater control which is responsive to the temperature of the hot end of the heat pipe. As working fluid condenses it is removed from the heat pipe. Liquid working fluid is recirculated into the heat pipe in discrete quantities by vapor bubble injection under the control of the heater and the heater control. If no fluid is injected into the heat pipe, the thermal conductance will decrease as condensate is removed. If fluid is injected into the heat pipe, thermal conductance will increase as fluid is supplied to the heat pipe.

4 Claims, 5 Drawing Figures

HEAT PIPE SWITCH

FIELD OF THE INVENTION

My invention relates to heat pipes in general and more particularly to heat pipes in which the thermal conductance is controllably variable.

BACKGROUND OF THE INVENTION

Heat pipes are utilized to transfer heat away from a source of heat to a heat sink. For example, heat pipes are useful in the control of the temperature of electronic equipment. Heat pipes may take various forms other than a tube or pipe from which common form the device takes its name. A typical heat pipe is a closed chamber containing a small amount of working fluid. The interior of the chamber contains a capillary wick which comprises a cluster of fine wire, a plurality of fins extruded on its interior walls, etc. The free space within the chamber contains only vapor of the working fluid at the saturation pressure of the fluid at the ambient temperature of the environment in which the heat pipe is to operate.

If the temperature of the heat source and hence one end of the heat pipe should rise above the ambient temperature, the liquid in that end vaporizes. The resulting vapor is at a higher pressure and hence will travel toward the lower pressure, cooler end of the heat pipe where it condenses. As the vapor condenses it gives up the latent heat acquired during vaporization. The capillary wick within the heat pipe is dimensioned to transport the condensate back to the heat source area by capillary action where the cycle is repeated.

In many heat pipe applications it is advantageous to be able to control the thermal conductance of the heat pipe. For example, electronic equipment may generate more heat during certain phases of operation and, therefore, require the removal of more heat to maintain a fixed temperature. Alternately, it may be desirable to operate particular equipment at a variety of temperatures. It is possible to accommodate both of these situations by removing heat from the equipment through a controllably variable conductance heat pipe.

Prior art heat pipes have controlled the fluid flow within the heat pipe by controllably blocking the fluid path between the evaporator section and the condenser section.

SUMMARY OF THE INVENTION

My invention comprises a heat pipe and a circulating supply of working fluid the circulation of which is controlled by vapor bubble injection means. Working fluid in the heat pipe vaporizes in the hot end of the heat pipe. The vapor travels to the cool end of the heat pipe where it condenses and gives up the latent heat acquired during vaporization. Condensed working fluid enters the circulating supply of working fluid and is removed from the heat pipe. If no working fluid is injected into the heat pipe, the thermal conductance of the heat pipe is reduced as fluid is removed. If working fluid is injected into the heat pipe the thermal conductance of the heat pipe will increase as the amount of working fluid provided to it is increased. The temperature of the heat source or the heat input section of the heat pipe can be monitored and utilized to control the vapor bubble injection and, accordingly, control the conductance of the heat pipe. If a cooler temperature is required, the thermal conductance can be increased by injecting additional fluid into the heat pipe and if a warmer temperature is required, fluid is allowed to collect in the supply thus lowering the thermal conductance of the heat pipe.

BRIEF DESCRIPTION OF THE DRAWING

The invention will be understood from the following detailed description when read with reference to the drawing in which.

DETAILED DESCRIPTION

Figure 1:
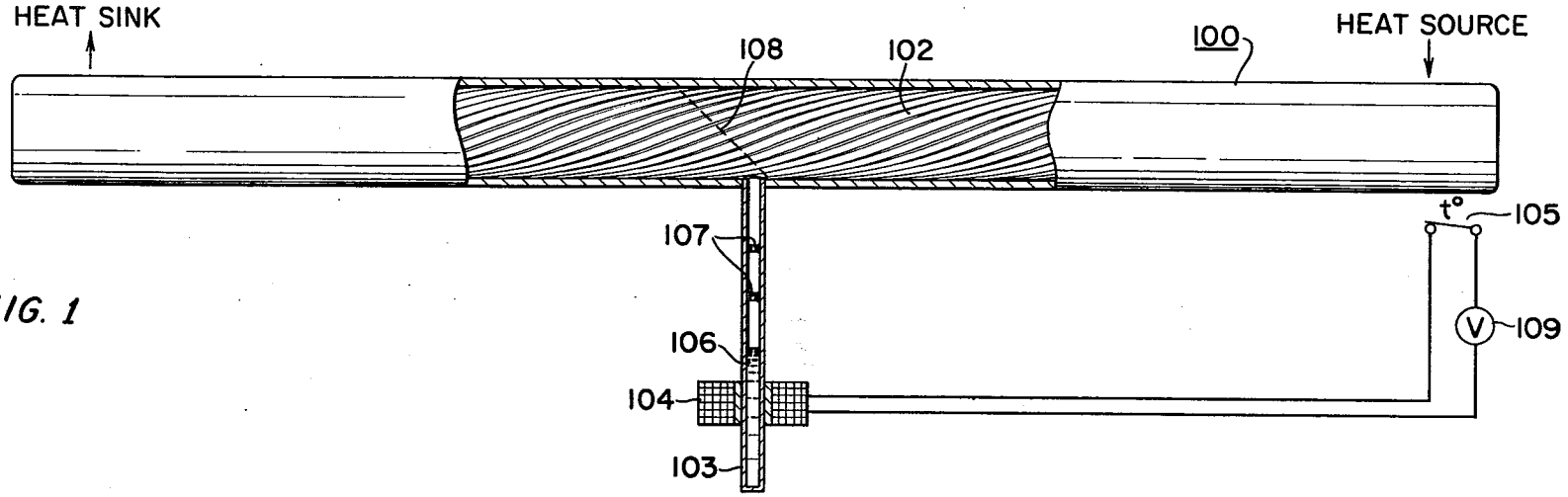
FIG. 1 through FIG. 4 are partially cutaway views of four embodiments of my invention.

FIG. 1 is a first embodiment of a variable conductance heat transfer device in accordance with my invention. The tubular reservoir 103 is connected near the middle of the heat pipe 100 forming a structure which resembles the letter "T". The heat pipe 100 has a capillary wicking surface 102 inside while the tubular reservoir 103 has a substantially smooth wall interior. A circulating supply of working fluid of a volume which is insufficient to completely fill the reservoir 103 when in the liquid state is hermetically sealed inside the otherwise evacuated structure.

If the reservoir 103 is sufficiently cool the working fluid will remain in the liquid state in the reservoir 103 (as shown by 106) and the heat pipe 100 will have low thermal conductance due to the absence of working fluid. If heat is applied to the reservoir 103 by means of the heater 104, vapor bubble injection commences. Whether vapor bubble injection will occur depends on the relationship of such factors as the adhesion of the liquid working fluid to the surface of the reservoir, the surface tension of the liquid, the density of the liquid, the pressure within the system, and the cross-sectional shape and size of the reservoir. One possible combination for the embodiment of FIG. 1 is the use of water as the working fluid and a round smooth wall tubular reservoir of ¼ inch diameter or smaller. As heat is applied to the reservoir 103, a vapor bubble will form in the liquid working fluid and grow until it separates from the wall of the reservoir and rises. For vapor bubble injection to occur, vapor bubbles must grow to fill the cross section of the reservoir before they break from the point of formation and rise in the reservoir. Vapor bubbles which so form entrap quantities of liquid working fluid 107 above each bubble and deliver the entrapped quantities of liquid working fluid 107 to the heat pipe 100 as the vapor bubbles rise in the reservoir. The number of vapor bubbles formed and accordingly the amount of liquid working fluid provided to the heat pipe is proportional to the heat applied to the reservoir 103.

The wicking surface 102 will carry the liquid working fluid to the hot end of the heat pipe where it will be vaporized. The vapor being at a higher pressure will travel to the lower pressure, cooler end of the heat pipe where it condenses. As the vapor condenses, it gives up the heat acquired during vaporization. The wicking surface 102 transports the condensate back toward the heat source area where the cycle would normally be repeated until the temperature of the heat source is reduced to the control temperature of the heat pipe. However, in my invention, a portion of the condensate is diverted to the reservoir and therefore the thermal conductance of the heat pipe 100 is gradually reduced as time passes unless additional working fluid is injected from the reservoir 103 into the heat pipe 100.

The thermostatic heater control 105 monitors the temperature of the heat source and connects the power supply 109 to the heater 104 to heat the reservoir 103 if the temperature of the heat source is above a preset temperature. If the heat source temperature falls below the preset temperature no heat will be applied to the reservoir 103 and it will be allowed to cool.

The wicking surface 102 could be replaced by any other wicking structure, e.g., a fine mesh wire screen, or the capillary wick can be partially or completely eliminated. To operate without a capillary wick, the apparatus must be titled with the heat source end below the heat sink end. In that mode the liquid working fluid would flow to the heat source end by force of gravity after being injected into the heat pipe. However, if no capillary wick is provided the evaporation surface area, and hence the efficiency of the apparatus, is reduced. A partial capillary wick, e.g., to the right of the dashed line 108 in FIG. 1, is another alternative. The partially wicked structure enhances the movement of the liquid working fluid to the heat source end of the heat pipe 100, provides a greater evaporation surface than no capillary wick and enhances the condensate diversion to the reservoir 103 by reducing the uncontrolled return which is present with a full length capillary wick.

Figure 2:
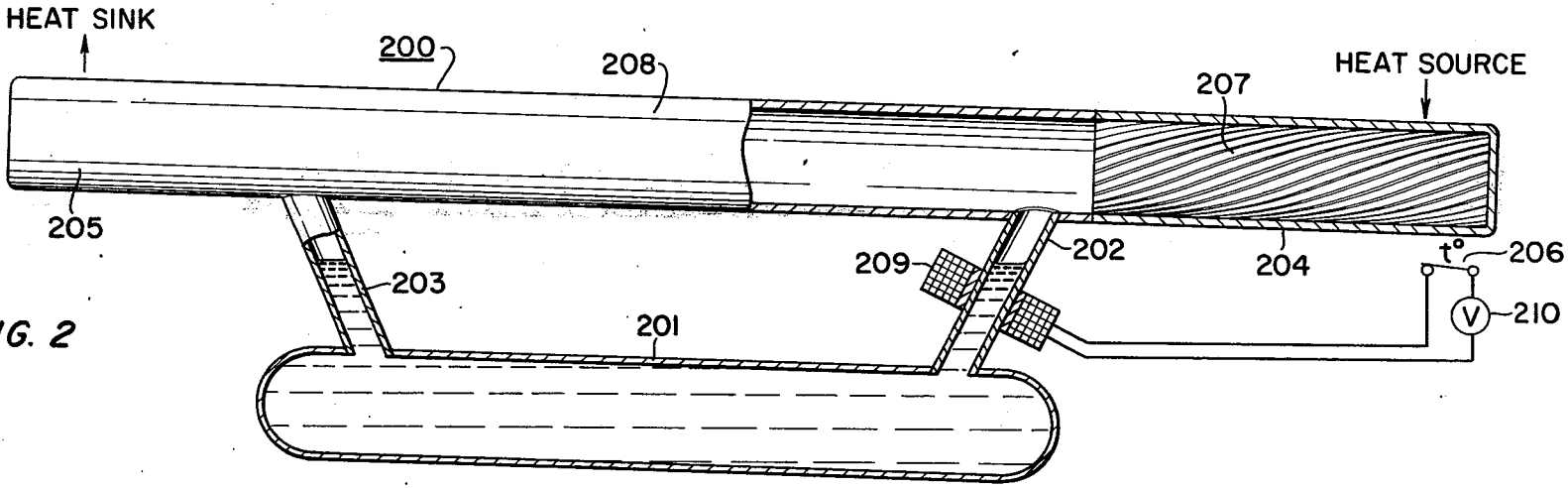

FIG. 2 shows a second embodiment of my invention. A heat pipe 200 comprises a condenser section 205, an evaporator section 204 and a midsection 208 interconnecting the evaporator and condenser sections. The evaporator section 204 has a capillary wicking surface 207 therein while the condenser section 205 and the midsection 208 have substantially smooth interior walls. A reservoir 201 is suspended beneath the heat pipe 200. A condensate return tube 203 connects the reservoir 201 to the condenser end of the midsection 208, and an injector tube 202 connects the reservoir 201 to the evaporator end of the midsection 208. A heater 209 encircles the injector tube 202 and applies heat to the injector tube 202 in response to signals from the heater control 206 which monitors the temperature of the heat source.

If the temperature of the heat source rises above a predetermined temperature, the heater control 206 will connect the power supply 210 to the heater 209 to apply heat to the injector tube 202. As the injector tube 202 is heated, vapor bubbles form in the injector tube 202 and rise toward the evaporator section 204. Small discrete portions of working fluid in the liquid state are entrapped above each vapor bubble and are injected into the evaporator end of the midsection 208. The injector tube 202 is inclined from the vertical toward the evaporator section to ensure that injected fluid reaches the wicking surface 207 of the evaporator section. As more heat is applied to the injector tube more vapor bubbles form and the vapor bubbles form in more rapid succession. The working fluid which is provided to the evaporator section 204 by this vapor bubble injection vaporizes due to the heat from the heat source. Because of the pressure differential between the evaporator and condenser sections, the vaporized working fluid travels to the condenser section 205 where the thermal energy is given up upon condensation of the vapor. The condensate then returns to the reservoir 201 via the condensate return tube 203. For proper operation the structure must be substantially level or be at a slight incline with the evaporator section 204 slightly below the condenser section 205.

If the temperature of the heat source is reduced below the predetermined temperature, the heater control 206 will disconnect the power supply 210 from the heater 209 to discontinue heating the injector tube 202. As the injector tube 202 cools, the vapor bubbles diminish until no bubbles are formed. If the bubble pump action of the injector tube 202 stops, no working fluid will be provided to the evaporator section 204 and all the condensate will accumulate in the reservoir 201. In this mode of operation, the thermal conductance of the heat pipe 200 will be greatly reduced and little thermal energy will be transferred from the heat source to the heat sink.

If the temperature of the heat source should again rise above the predetermined temperature, the heater control 206 will again connect the power supply 210 to the heater 209 to heat the injector tube 202 and the operation is as previously described. Thus, the thermal conductance of the heat pipe 200 is controlled to regulate the temperature of the heat source.

The embodiments of my invention shown in FIG. 1 and FIG. 2 utilize an active control arrangement to vary the thermal conductance of a heat pipe. A third embodiment shown in FIG. 3 utilizes a passive control arrangement. A heat pipe 300 comprises an evaporator section 301, a condenser section 302, and an interconnecting midsection 308. The condenser section 302 and midsection 308 have substantially smooth interior walls while the evaporator section 301 has a capillary wicking surface 303 therein. The reservoir 304 is connected to the midsection 308 by the passage 309 to collect the condensate as it condenses. To aid condensate return to the reservoir 304, the apparatus can be inclined with the evaporator section 301 below the condenser section 302; of course this return aid can be built into the condenser section by inclining the lower interior surface of the condenser section 302 as indicated by the dashed line 305.

Figure 3:
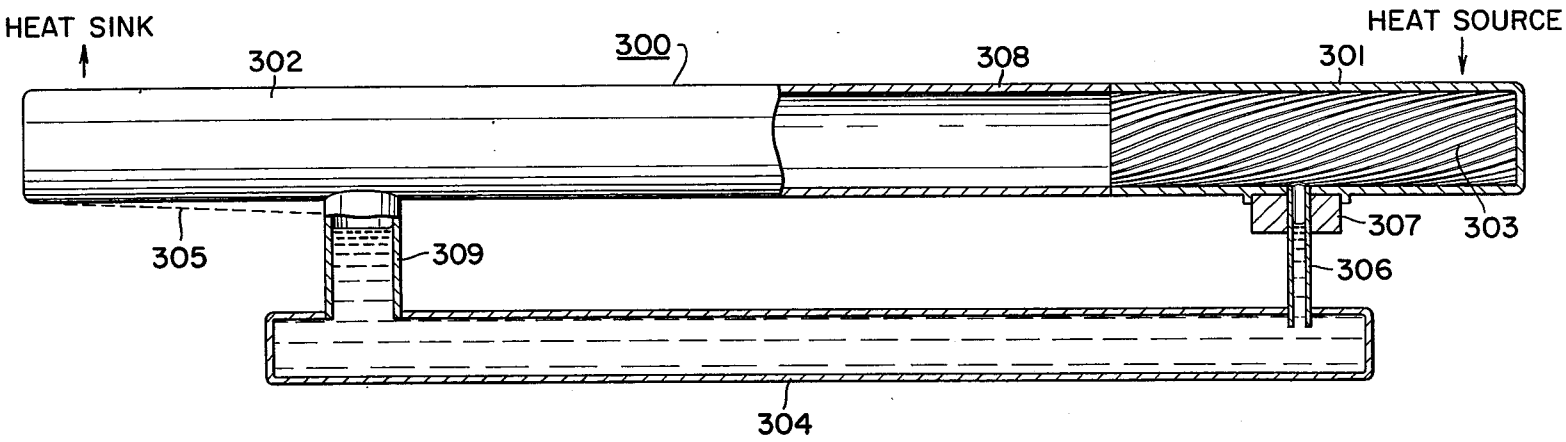

The passive control arrangement of FIG. 3 comprises an injector tube 306 which interconnects the reservoir 304 and the evaporator section 301 and a cylindrical slug 307 composed of a highly thermal conductive material (e.g., copper, brass, aluminum, etc.) surrounding and in contact with the injector tube 306 and connected to the evaporator section 301. The heat from the evaporator section 301 is transferred through the slug 307 to the injector tube 306. As the temperature of the slug 307 rises, more heat is applied to the injector tube 306 and vapor bubble injection will commence at a predetermined temperature and increase as the temperature increases further. Accordingly, more working fluid will be delivered to the heat pipe 300 as the temperature of the evaporator section 301 increases resulting in higher thermal conductance of the heat pipe 300 and accordingly greater heat removal.

If the temperature of the evaporator section 301 goes below the predetermined temperature, the vapor bubble injection will stop and the heat pipe 300 will be deprived of working fluid becoming a poor thermal conductor.

Figure 4:
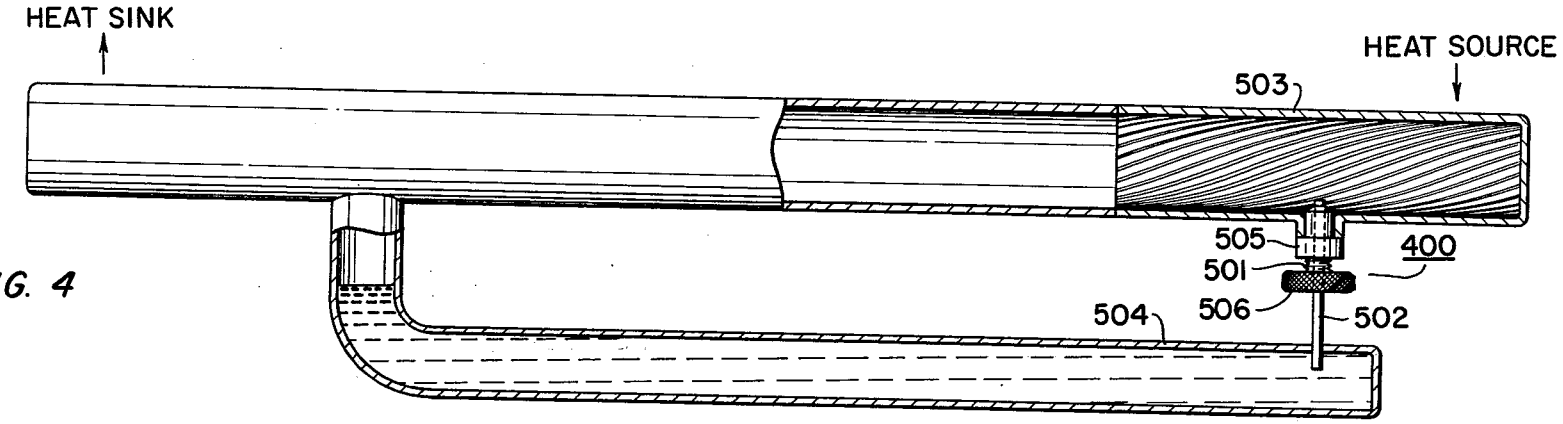
Figure 5:
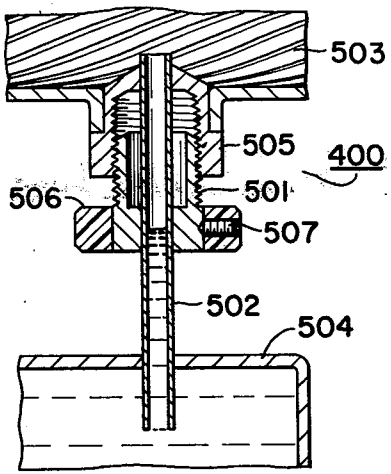
FIG. 5 is a detailed cutaway view of an adjustable thermal feedback arrangement used in the embodiment of FIG. 4.

The control temperature of the apparatus can be changed by varying the size of the injector tube 306, using one of a variety of working fluids, varying the level of the working fluid in the reservoir and injector tube and by varying the composition of the cylindrical slug 307 or the location at which the cylindrical slug 307 makes contact with the injector tube 306. A movable slug is utilized as the means of varying the control temperature of the apparatus in a fourth embodiment of my invention which is shown in FIG. 4. The cylindrical slug 307 of FIG. 3 has been replaced in FIG. 4 by an adjustable slug assembly 400 which is detailed in a cutaway view in FIG. 5.

The sleeve 505 is composed of a highly thermal conductive material and is spaced apart from an encircles the injector tube 502. The upper end of the sleeve 505 has a horizontally truncated conical closure which extends into the evaporator section 503 and is hermetically sealed to the injector tube 502. The lower end of the sleeve 505 is open and has screw threads on its interior walls. The sleeve 505 is hermetically sealed into the evaporator section 503 which ensures an air tight structure as well as good thermal conductance between the two. The slug 501 is a cylinder composed of highly thermal conductive material which has been double bored to have a first bore approximately twice the external diameter of the injector tube 502 for two thirds of its length and a second bore approximately equal to the injector tube external diameter for the remaining third of its length. The slug 501 has screw threads on the exterior of the section of the slug 501 having the larger bore. The screw threads on the slug 501 engage the screw threads in the sleeve 505 so that the slug can be adjusted along the axis of the injector tube 502 by turning the slug 501 by means of the knurled collar 506. The knurled collar is composed of a low thermal conductance material and is attached to the slug 501 by means of the set screw 507. The injector tube 502 fits tightly within the small bore of the slug 501 to ensure good thermal conduction between the two. By screwing the slug 501 in the sleeve 505, the contact location between the slug 501 and the injector tube 502 can be varied. As the slug 501 is moved toward the reservoir, the control temperature of the apparatus decreases as less heat is required to effect vapor bubble injection. Likewise as the slug 501 is moved away from the reservoir, the control temperature is increased.

What is claimed is:

1. Thermal energy transfer apparatus comprising:

a heat pipe comprising a heat receiving end and a heat discharging end;

a quantity of working fluid;

means connected to said heat pipe for circulating said working fluid; and means for heating at least a portion of said circulating means to inject discrete quantities of fluid in its liquid state into said heat pipe, said heating means comprising a cylindrical slug of a thermally conductive material adjacent to said heat receiving end of said heat pipe for transferring thermal energy from said heat pipe to said circulating means.

2. Apparatus in accordance with claim 1 further comprising means for varying the position of said thermally conductive cylindrical slug with respect to said heat pipe.

3. Thermal energy transfer apparatus comprising:

a heat pipe having a heat receiving end and a heat discharging end;

a reservoir suspended below said heat pipe and connected to said heat receiving end by a first passage comprising a tube having a smooth interior wall and composed of thermally conductive material, and connected to said heat discharging end by a second passage;

fluid of a quantity which is sufficient to totally fill said reservoir but insufficient to fill said first and second passages;

a cylindrical slug composed of thermally conductive material encircling said first passage and in thermal contact therewith and connected to said heat receiving end of said heat pipe for heating said first passage to inject discrete quantities of said fluid in its liquid state into said heat pipe; and said heat pipe, said reservoir and said first and second passages being hermetically sealed and evacuated except for said fluid.

4. Apparatus in accordance with claim 3 wherein said cylindrical slug is adjustably connected to said heat receiving end of said heat pipe such that the contact with said first passage can be varied axially along said first passage over a predetermined range.

* * * * *